United States Patent [19]

Gillette et al.

[11] Patent Number: 4,775,286

[45] Date of Patent: Oct. 4, 1988

[54] HYDRAULIC HOSE ROUTING FOR TRACTOR-MOUNTED BACKHOE

[75] Inventors: Roy A. Gillette; Robert L. Houkom; Curtis R. Lyons, all of Burlington, Iowa

[73] Assignee: J. I. Case Company, Racine, Wis.

[21] Appl. No.: 152,664

[22] Filed: Feb. 5, 1988

[51] Int. Cl.[4] ..... E02F 5/00

[52] U.S. Cl. ..... 414/687; 180/139; 248/52; 280/421; 414/918

[58] Field of Search ..... 414/687, 918, 744 R; 180/139; 280/421; 248/52, 51; 24/329, 335, 20 CW

[56] References Cited

U.S. PATENT DOCUMENTS

| | | | |
|---|---|---|---|
| 2,756,039 | 7/1956 | Barrett | 262/29 |
| 3,082,890 | 3/1963 | Van Auwelaer et al. | 214/138 |
| 3,120,897 | 2/1964 | Van Auwelaer et al. | 214/138 |
| 3,236,394 | 2/1966 | McMullen | 212/66 |
| 3,263,839 | 8/1966 | Hauff | 214/138 |
| 3,627,155 | 12/1971 | Van Der Zyl | 214/138 |
| 3,722,916 | 3/1973 | Muntjanoff | 280/421 |
| 3,872,881 | 3/1975 | Miller et al. | 280/421 X |
| 3,872,985 | 3/1975 | Short | 414/744 R |
| 4,234,012 | 11/1980 | Schupback | 137/899 |
| 4,557,448 | 12/1985 | Brown et al. | 248/75 |

FOREIGN PATENT DOCUMENTS

| | | | |
|---|---|---|---|
| 837242 | 6/1960 | United Kingdom | 180/139 |

*Primary Examiner*—Robert J. Spar
*Assistant Examiner*—Donald W. Underwood
*Attorney, Agent, or Firm*—Peter N. Jansson

[57] ABSTRACT

An improved swingable tractor-backhoe interconnection for a tractor-mounted backhoe having a pair of vertically-spaced articulation means along the axis forming an axially-aligned void space therebetween, a preferably free-floating center yoke in the void space with two vertical rows of openings securing hydraulic hoses in two adjacent rows, and a pair of side yokes on the tractor, one for each row of hoses, positioned on opposite sides of the center plane and spaced from the axis and center plane such that the two rows of hoses are divergent between the center and side yokes.

11 Claims, 2 Drawing Sheets

HYDRAULIC HOSE ROUTING FOR TRACTOR-MOUNTED BACKHOE

FIELD OF THE INVENTION

This invention is related generally to tractor-mounted backhoes with swingable backhoe booms and, more particularly, to the multiplicity of hydraulic interconnections between the tractor and various backhoe-mounted cylinders for controlling various backhoe movements.

BACKGROUND OF THE INVENTION

In conventional tractor-mounted backhoe assemblies, including both those with fixed backhoe pivots and those which are sideshift backhoes, a number of hydraulic lines typically run between the tractor and the hydraulic cylinders of the backhoe to carry hydraulic fluid to and from the cylinders controlling the movable parts of the backhoe. In extending from the hydraulic pumps on the tractor to the cylinders on the backhoe, the hoses must pass by or through a backhoe swing tower which pivots with respect to the tractor, usually by about 180 degrees, to provide the backhoe its range of lateral movement.

A variety of schemes and arrangements have been used to connect hydraulic hoses to movable vehicle-attached implements such as tractors. Specific examples of apparatus of the prior art include the following U.S. Pat. Nos.:

3,082,890 (Van Auwelaer et al.);
3,120,897 (Van Auwelaer et al.);
3,263,839 (Hauff);
3,627,155 (Van Der Zyl);
3,722,916 (Muntjanoff);
4,234,012 (Schupback);
3,236,394 (McMullen);
2,756,039 (Barrett); and
4,557,448 (Brown et al.).

Prior hydraulic hose connection schemes and arrangements have significant problems and disadvantages, primarily relating to excessive hose wear. There are several reasons for these problems, including location of hoses in excessively exposed positions, rubbing of hoses against hard surfaces, rubbing of hoses against adjacent hoses, crowding of hoses into confined spaces, hose contortion, and various combinations of reasons.

Generally speaking, it is desirable for hydraulic hoses to pass through rather than around the swinging interconnection of the backhoe to the tractor, that is, through the backhoe swing tower. This puts the hoses in a generally less exposed position than would otherwise be the case. However, crowding of hoses in the confined space which is typically at the focal point of the swinging implement mount exacerbates hose wear problems.

More specifically, while there is limited space in the swing tower, the multiple functions of the backhoe require that several hydraulic hoses be routed through such tower. Backhoes typically have the need for at least six and frequently a many as eight hydraulic hoses to extend from the tractor to the backhoe, including a pair of hoses for each of the following hydraulic cylinders: a bucket cylinder, a dipper cylinder, a boom cylinder, and in many cases a cylinder for extending the reach of the backhoe. This multiplicity of hoses often causes excessive rubbing and hose wear in one way or another.

If two or more hoses in such confined space are arranged against one another, along parallel, usually horizontal, straight lines at generally the same level and extending generally across the vertical axis defined by the pivoting connection of swing tower to tractor, the sides of such adjacent hoses will often rub together. The swinging of the backhoe from one side to another about the vertical axis tends to cause the inner sides of hoses in the outer position (with respect to the direction of swing) to contact and rub forcefully against the outer sides of hoses in the inner position.

In order to reduce hose wear, one conventional arrangement has horizontally-extending portions of each of the hydraulic hoses stacked in parallel fashion into a single stack which passes through or very near the pivot axis of the swing tower. However, when the pivoting interconnection of backhoe swing tower and tractor tower mount includes two vertically-spaced upper and lower articulations, such vertical hose stacking may not be possible. Or the stacking and the space limitation may in any event result in harmful rubbing and chafing during backhoe swinging.

Such rubbing and wear problems are often made worse because the hydraulic hoses, which are built to handle relatively high pressure, are typically thick rubberized and coated fabrics which are not very compliant. Any twisting of the line and even the bends and directions of the hose beyond the area of the backhoe swing tower have a tendency to cause the hose, as backhoe swings from side to side, to move in unpredictable ways from the intended hose position and orientation. Thus, hoses which are stacked in contact tend to rub one another in ways causing wear.

Various prior art hydraulic hose arrangement schemes have failed to adequately protect hydraulic hoses extending by or through backhoe swing towers against excessive hose wear. Improved apparatus is needed.

OBJECTS OF THE INVENTION

It is an object of this invention to provide an improved hydraulic hose routing for tractor-mounted backhoes overcoming some of the problems and shortcomings of the prior art.

Another object of this invention to provide an improved arrangement for flexible hydraulic hoses from a tractor to backhoe cylinders in order to minimize wear of hydraulic hoses.

Another object of this invention is to provide an improved hydraulic hose routing arrangement for swingable backhoes allowing several hoses to extend to the backhoe in fairly unexposed positions yet without excessive rubbing one on another.

Another object of this invention is to provide an improved hydraulic hose routing scheme by which all hoses extend through the limited pivot axis area between a backhoe and tractor without bunching in either a vertical or a horizontal direction.

These and other important objects will be apparent from the following descriptions and from the drawings.

SUMMARY OF THE INVENTION

This invention is an improved swingable tractor-backhoe interconnection of the type including a tractor, a backhoe, and a plurality of flexible hydraulic supply hoses extending from the tractor to the backhoe. Such backhoe (either the conventional or side-shiftable type) have a swing tower pivotably joined to the tractor by articulation means, which define a swing tower pivot axis and a vertical center plane (imaginary) extending toward the tractor. The invention, hereafter described, overcomes some of the problems and shortcomings of the prior art, including those mentioned above.

More specifically, the invention provides an improved hydraulic hose routing and mounting arrangement which minimizes wear of hydraulic hoses, eliminating excessive rubbing hoses one on another and elminating bunching of hydraulic hoses in either a vertical direction or a horizontal direction.

In the improved swingable tractor-backhoe interconnection of this invention, as in certain tractor-backhoe connections of the prior art, a pair of vertically-spaced articulation means along the pivot axis form an axially-aligned void space therebetween. In this invention, the hydraulic hoses extend through such void space in two vertical rows.

A center yoke is situated in the aforementioned void space, such center yoke having two vertical rows of openings with the hydraulic hoses secured thereto in two adjacent vertical rows. A pair of side yokes are located on the tractor, each side yoke having openings with the hoses of one of the vertical rows of hoses secured therethrough.

The side yokes are positioned on opposite sides of the aforementioned center plane and they are spaced from the axis and from the center plane such that the two rows of hoses are divergent betwee the center yoke and the two side yokes. This hose routing and mounting arrangement keeps the many hydraulic hoses away from each other and away from hard edges and surfaces to avoid crimping, rubbing, and undue wear on the hoses.

The two divergent vertical rows of hydraulic hoses diverge along generally curved paths which are smooth in the mathematical sense. When the backhoe swing tower is in its central position (aligned along the center plane), the divergent paths of the two vertical rows of hoses are preferably generally symmetrical with respect to the center plane. The side yokes are preferaly in mirror-image positions with respect to the center plane.

The divergent paths of the two vertical rows of hoses are concave outwardly, the positioning of the yokes and the curvature of the hydraulic hoses being such that the degree of outward concavity increases for one row while it decreases for the other during movement of the swing tower in one direction, and vice versa. In preferred embodiments, when the swing tower is pivoted to a position 90 degrees from the center plane, a portion of one of the rows of hoses adjacent to the center yoke approaches parallelism with a corresponding portion of the other row of hoses. This occurs without hose contact.

In highly preferred embodiments, the center yoke is free floating, that is, it is unattached to any portion of the tractor or backhoe, instead being secured only to the hydraulic hoses as described. In preferred embodiments, the side yokes are affixed with respect to the tractor. In preferred embodiments, the side yokes are on substantially the same level (above ground) as the center yoke.

The yokes have a separate opening for each hose extending therethrough, such openings most preferably being spaced such that the hoses extending through the yokes will not contact one another. Each of the side yokes preferably forms a substantially straight vertical row of openings. In the center yoke, the two vertical rows of openings are preferably substantially straight and parallel to one another such that the two adjacent vertical rows of hoses therein are substantially straight and parallel to one another.

In preferred embodiments, the center yoke is spaced from the swing tower pivot axis in a direction toward the backhoe such that the rows of hoses are divergent as they pass the vertical pivot axis itself. This arrangement minimizes any strain on the hydraulic hoses of the improved swingable tractor-backhoe interconnection of this invention.

DETAILED DESCRIPTIONS OF PREFERRED EMBODIMENTS

The figures show swingable tractor-backhoe interconnection 10 pivotably joining a backhoe swing tower 12 to a tractor 14.

Figure 4:
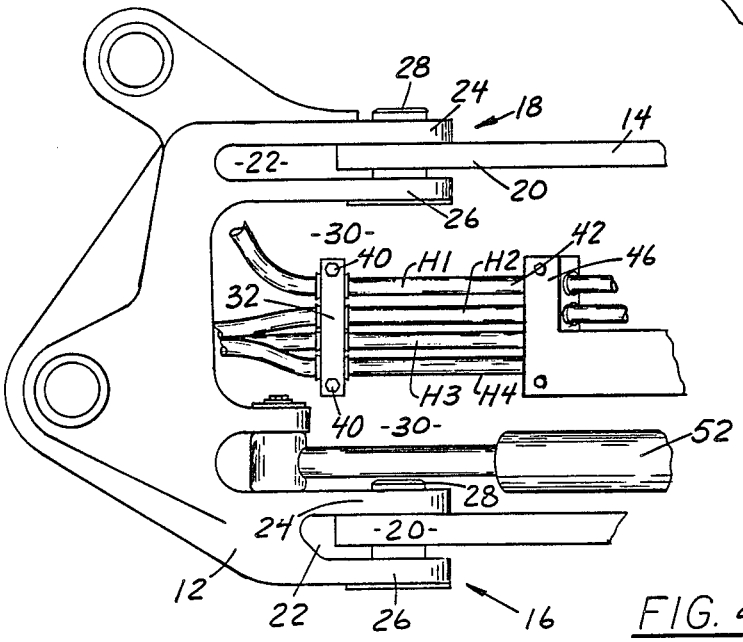
FIG. 4 is a side elevation.

Backhoe swing tower 12 is pivotably connected with tractor 14 by means of lower and upper articulations 16 and 18. Each of the articulations 16 and 18 includes a horizontal support plate 20 which forms part of tractor 14 and is received in a slot 22 formed between first and second horizontal members 24 and 26 of backhoe swing tower 12. Each of the articulations 16 and 18 also includes a pivot pin 28 (see FIG. 4) extending through horizontal members 24 and 26 and horizontal support plate 20.

Pivot pins 28 of lower and upper articulations 16 and 18 are axially aligned and define a swing tower pivot axis. Lower and upper articulations 16 and 18 ar spaced along such pivot axis and form an axially aligned void space 30 therebetween through which hoses H1 to H8 extend.

As already indicated, description of this invention is facilitated by reference to an imaginery vertical center plane which includes the swing tower pivot axis and extends toward tractor 14. Swing tower 12 can pivot about the pivot axis through an arc of 180 degrees—90 degrees on either side of the vertical center plane. First and second hydraulic swing cylinders 52 and 54 extend from tractor 14 to backhoe swing tower 12, in well-known manner. The operation of first and second hydraulic swing cylinders 52 and 54 controls the rotational position of swing tower 12 with respect to tractor 14.

Located in void space 30 at a position close to the swing tower pivot axis, but spaced from it in a direction toward the backhoe, is a center yoke 32. Center yoke 32 is free-floating, that is, unconnected either to backhoe swing tower 12 or tractor 14. Center yoke 32 includes first and second center yoke portions 34 and 36 which are generally parallel to each other and serve to hold two separate rows of hoses.

First and second center yoke portions 34 and 36 each form a vertical row of four openings such that center yoke 32 has means to secure each of the eight hydraulic hoses H1 through H8. More specifically, first center yoke portion 34 has openings for hoses H1 through H4 and second center yoke portion 36 has openings for hoses H5 through H8.

Figure 1:
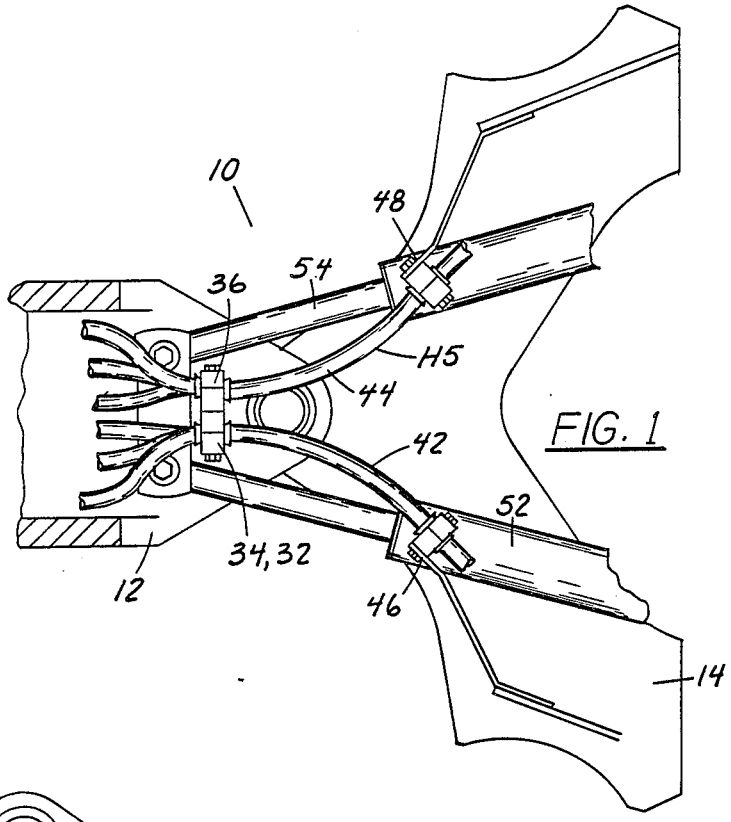
FIG. 1 is a top view of a swingable tractor-backhoe interconnection in accordance with this invention, with the backhoe swing tower in a center position.
Figure 2:
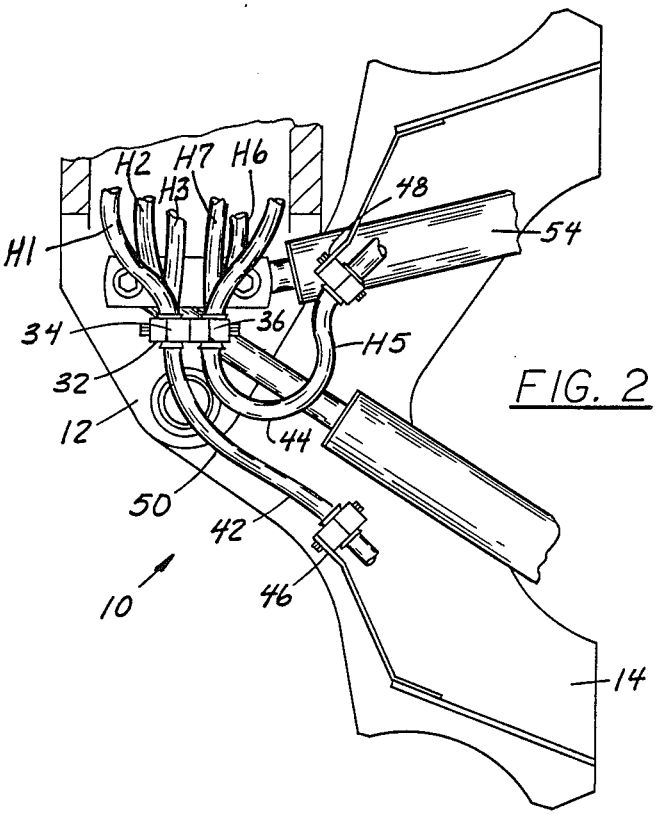
FIG. 2 is another top view as in FIG. 1, but showing the interconnection with the backhoe swing tower in one of its two 90-degree off-center positions.
Figure 3:
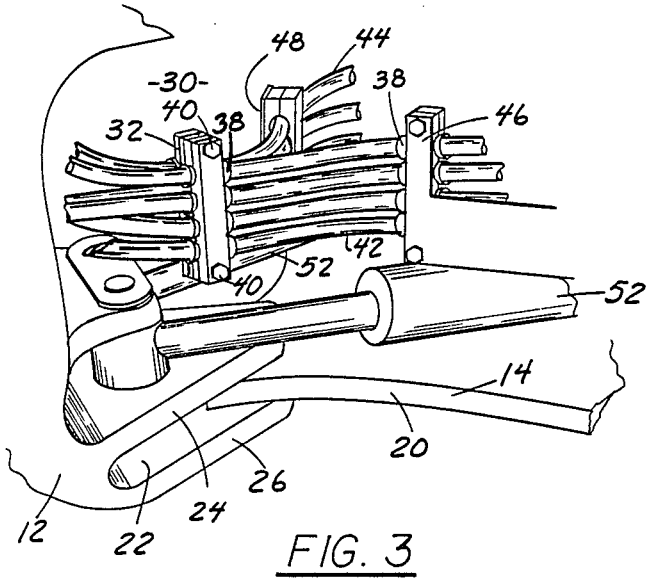
FIG. 3 is a perspective view.

A sleeve element 38 having flared ends is firmly sleeved over each hose at the position of its engagement with center yoke 32. As shown in FIGS. 1–3, first and second center yoke portions 34 and 36 each have two sections which clamp about sleeves 38. Center yoke 32 also includes bolts 40 which are means to draw the portions of center yoke 32 together to firmly secure sleeve members 38 thereto, and in that manner to secure hoses H1 through H8 in fixed positions through center yoke 32.

Thus, center yoke 32 supports the hoses in two adjacent straight vertical rows. Hoses H1 through H4 form a first group (or row) 42 of hoses and hoses H5 through H8 (only H8 is not shown) form a second group (or row) 44 of hoses. Rows 42 and 44 are closely adjacent to each other as they pass through center yoke 32.

When backhoe swing tower 12 is centered on the vertical center plane, such plane bisects center yoke 32 such that first and second center yoke portins 34 and 36 are on opposite sides thereof. This position of backhoe swing tower 12 is illustrated in FIG. 1.

First and second side yokes 46 and 48 are affixed to tractor 14 in positions on opposite sides of the aforementioned center plane. Side yokes 46 and 48 are spaced from the pivot axis in position just beyond void space 30 and they are spaced from the from the center plane as well. The positioning of side yokes 46 and 48 with respect to center yoke 32 will hereafter be described.

Like each of the first and second center yoke portions 34 and 36, side yokes 46 and 48 each have four openings two parts to facilitate gripping of sleeve members 38 firmly engaged on the hoses. Bolts serve to clamp the side yokes about the sleeves and their hoses.

In this manner, first side yoke 46 firmly secures each of the four hoses of the first row 42 of hoses, and second side yoke 48 firmly secures each of the hoses of the second row 44 of hoses. Thus, a fixed length of each of the hoses extends between its point of securement to center yoke 32 and its point of securement to either side yoke 46 or side yoke 48. The hoses of hose row 42 are all parallel to one another between center yoke 32 and first side yoke 46, while the hoses of second hose row 44 are all parallel to one another between center yoke 32 and second side yoke 48.

The positioning of first and second side yokes 46 and 48, on opposite sides of the center plane and spaced from the pivot axis and center plane, and the place of securement of hoses within yokes 32, 46 and 48, are such that first and second rows 42 are divergent between center yoke 32 and their corresponding side yokes 44 and 46. Side yokes 46 and 48 are at the same level (above ground) as is center yoke 32, and side yokes 46 and 48 are in mirror-image positions with respect to the center plane.

Side yokes 46 and 48 are each oriented to facilitate divergence of hose rows 42 and 44. That is, they are oriented neither parallel to the vertical plane nor perpendicular thereto; instead they are at an angle therebetween, for example, at 45 degrees thereto.

When backhoe swing tower 12 is in the center position, as shown in FIG. 1, first and second hose rows 42 and 44 are divergent essentially all the way from center yoke 32 to side yokes 46 and 48. Throughout these distances, hose rows 42 and 44 are concave outwardly when swing tower 12 is positioned along such center plane.

The positioning of the yokes and hose curvature are such that regardless of the rotational position of backhoe swing tower 12 with respect to tractor 14, the hoses of row 42 will not contact the hoses of row 44. Indeed, during movement of swing tower 12 to a position 90 degrees from the center plane, as illustrated in FIG. 2, a portion 50 of one of the hose rows adjacent to center yoke 32 approaches parallelism with the corresponding portion of the other row of hoses, yet without any hose contact. During such movement, portion 50 changes from an orientation of outward concavity to an orientation of slight outward convexity, while beyond portion 50 hose rows 42 and 44 diverge toward their respective side yokes 46 and 48. At no point during swing-tower movement in either direction is there any contact between the hoses of row 42 and the hoses of row 44.

The previously described means for securement of hoses within yokes 32, 46 and 48 includes hose openings vertically spaced from one another such that the hoses of each of the rows do not contact one another. Such spacing is sufficient so that swing tower movement does not result in any hose-to-hose contact within either of rows 42 or 44, despite internal tensions within the hoses.

The exact positioning of center yoke 32 can be varied somewhat. However, it is highly preferred that center yoke 32 be located at a position spaced from the pivot axis in a direction toward the backhoe. The position of side yokes 46 and 48 can be varied as well, as long as the positioning of the yokes avoids contact of hose rows 42 and 44.

The swingable tractor-backhoe interconnection of this invention may be made using parts and materials which are well-known to those skilled in the art. The method and means for construction will be apparent to those skilled in the art who are familiar with this invention.

While the principles of this invention have been described in connection with specific embodiments, it should be understood clearly that these descriptions are made only by way of example and are not intended to limit the scope of the invention.

We claim:

1. In a swingable tractor-backhoe interconnection of the type having a tractor with a plurality of flexible hydraulic supply hoses and a backhoe with a swing tower joined to the tractor by articulation means, the articulation means defining a swing tower pivot axis and a vertical center plane extending toward the tractor, the improvement comprising:

a pair of vertically-spaced articulation means along the axis forming an axially-aligned void space therebetween;

a center yoke in the void space with two vertical rows of openings, the hoses secured therethrough for support in two adjacent rows; and a pair of side yokes on the tractor, each side yoke having openings with the hoses of one of the rows secured therethrough, the side yokes positioned on opposite sides of the center plane and spaced from the axis and center plane such that the two rows of hoses are divergent between the center and side yokes.

2. The apparatus of claim 1 wherein the center yoke is free-floating.

3. The apparatus of claim 1 wherein the side yokes are affixed with respect to the tractor.

4. The apparatus of claim 1 wherein the side yokes are on substantially the same level as the center yoke.

5. The apparatus of claim 1 wherein the side yokes are in mirror-image positions with respect to the center plane.

6. The apparatus of claim wherein the yokes have separate openings for each hose.

7. The apparatus of claim 6 wherein the openings on each yoke are spaced such that the hoses will not contact one another.

8. The apparatus of claim 1 wherein each of the side yokes has a substantially straight vertical row of openings.

9. The apparatus of claim 1 wherein the two vertical rows of openings in the center yoke and the two adjacent rows of hoses therein are substantially straight and parallel to one another.

10. The apparatus of claim 1 wherein the center yoke is spaced from the swing tower pivot axis in a direction toward the backhoe such that the rows of hoses are divergent as they pass the axis.

11. The apparatus of claim 1 wherein the divergent rows of hoses are concave outwardly when the swing tower is positioned along the center plane, the positioning of the yokes and base being such that when the swing tower is pivoted to a position 90 degrees from the center plane a portion of one of the rows of hoses adjacent to the center yoke approaches parallelism with a corresponding portion of the other row of hoses without hose contact.

* * * * *

UNITED STATES PATENT AND TRADEMARK OFFICE

CERTIFICATE OF CORRECTION

PATENT NO. : 4,775,286

DATED : October 4, 1988

INVENTOR(S) : Roy A. Gillette; Robert L. Houkom; Curtis R. Lyons

It is certified that error appears in the above-identified patent and that said Letters Patent is hereby corrected as shown below:

In column 1, line 63, change "a" to --as--.

In column 3, line 2, change "have" to --has--.

In column 3, line 3, change "define" to --defines--.

In column 3, line 31, change "betwee" to --between--.

In column 3, line 43, change "preferaly" to --preferably--.

In column 4, line 42, change "ar" to --are--.

In column 5, line 29, omit the first instance of the words "from the".

In column 5, line 34, before the phrase "two parts", insert the words --and each have--.

Signed and Sealed this

Twenty-first Day of February, 1989

*Attest:*

*Attesting Officer*

DONALD J. QUIGG

*Commissioner of Patents and Trademarks*